US005687596A

United States Patent [19]

Vianello et al.

[11] Patent Number: 5,687,596

[45] Date of Patent: Nov. 18, 1997

[54] CALENDERING ALUMINUM PROFILES FOR PRODUCING SPACER FRAMES FOR INSULATING GLAZING UNITS

[75] Inventors: Fortunato Vianello, Vallio di Roncade; Dino Moschini, San Cipriano, both of Italy

[73] Assignee: FOR.EL. BASE di Vianello Fortunato & C. S.n.c., Vallio di Roncade, Italy

[21] Appl. No.: 548,940

[22] Filed: Oct. 26, 1995

[30] Foreign Application Priority Data

Oct. 31, 1994 [IT] Italy ..... TV94A0127

[51] Int. Cl.[6] ..... B21D 7/028; B21D 7/12

[52] U.S. Cl. ..... 72/14.8; 72/307

[58] Field of Search ..... 72/307, 294, 369, 72/168, 177, 14.8

[56] References Cited

U.S. PATENT DOCUMENTS

| | | | |
|---|---|---|---|
| 3,452,568 | 7/1969 | Vihl | 72/168 |
| 3,885,412 | 5/1975 | Vance | 72/369 |
| 3,964,289 | 6/1976 | Williamson | 72/369 |
| 4,391,116 | 7/1983 | Yogo | 72/168 |
| 4,773,284 | 9/1988 | Archer | 72/307 |
| 5,104,026 | 4/1992 | Sturrus | 72/369 |
| 5,161,401 | 11/1992 | Lisec | 72/307 |

FOREIGN PATENT DOCUMENTS

| | | |
|---|---|---|
| 380 527 | 6/1986 | Austria . |
| 0 332 049 | 9/1989 | European Pat. Off. . |
| 0332049 | 6/1992 | European Pat. Off. . |
| 89 07495 | 8/1989 | WIPO . |

*Primary Examiner*—Daniel C. Crane

*Attorney, Agent, or Firm*—Guido Modiano; Albert Josif

[57] ABSTRACT

An automatic method and device for calendering aluminum profiles for producing spacer frames for insulating glazing units, the method consisting in producing calendering by preliminarily deforming the surface on which minute holes are formed so as to obtain an inside curve. A consecutive plurality of minute bends, the pitch increment whereof tends to zero and the bending angle increment whereof tends to zero, is then performed at an automatically controlled microbending station.

14 Claims, 4 Drawing Sheets

CALENDERING = n-BENDS.

CALENDERING ALUMINUM PROFILES FOR PRODUCING SPACER FRAMES FOR INSULATING GLAZING UNITS

BACKGROUND OF THE INVENTION

The present invention relates to an automatic method and device for calendering aluminum profiles for producing spacer frames for insulating glazing units.

In the specific field of machines for machining the components of insulating glazing units, which are constituted by two glass plates between which a spacer frame usually constituted by a bent aluminum profile is interposed, the leading manufacturers have developed and built specific machines for automatically bending and semiautomatically or automatically calendering said hollow aluminum profiles in order to obtain the spacer frame.

Accordingly, it is known to perform bending and, separately, calendering at independent machines; as an alternative, if they are carried out on the same machine unit, these machining operations occur in independent steps of the production cycle; this known method entails manually transferring the partially machined profile from the station for bending and marking the centerline of the curve to be formed to the calendering station.

Said calendering station is essentially constituted by three rollers of adequate diameter: one is an intermediate roller and the other two are end rollers.

A notch formed on the inside wall of the profile in the preceding bending station is positioned at the intermediate roller.

This notch acts as a register for the centerline of the curved band to be obtained by virtue of a back-and-forth movement between the three rollers.

Even if the calendering process is performed in a computer-assisted mode, that is to say, after supplying the information related to the shapes of the radius of curvature and of the breadth of the angle of curvature respectively, drawbacks are observed even though calendering is performed automatically: the need to manually transfer the bent and notched profile from the bending station to the calendering station, and the duplication of the placements in the calenderer, in addition to the repetitions of the duplications if a plurality of calendered regions are required, make the overall bending-calendering process too demanding from the point of view of manual work, and the qualitative result, including the aesthetic one, highly depends on the precision with which the centerline of the region to be bent, identified by the registering notch, is positioned manually.

It is also known to perform combined bending and calendering, using a machine in which the two processes occur; that is to say, there is a machining head that performs equally either bending, by means of a punch and a rotation arm, or calendering, by means of a wheel and a rotation arm that is converted and arranged so as to become a contrast arm.

A severe shortcoming of this method and of this machine is due to the fact that in order to switch from bending to calendering it is necessary to manually change the tool, and this occurs according to the succession of shapes (folds or curves) required in the spacer frame; the pattern of this succession can entail more than one tool change.

A possible alternative could be to first form only the bends on all the frames belonging to the same batch and then calender said frames, so as to change tools only once per batch instead of changing tools for each frame: this alternative, however, is not allowed, since the design of the machine is such that it requires feeding with a continuous straight profile obtained by gradually and automatically joining the bars of the profile.

A further shortcoming of this method is the difficulty, and the consequent poor aesthetic result, of producing small radiuses, since calendering is obtained by pushing the profile, which passes between the wheel, the lower face of the vice, and the contrast arm.

Since said contrast arm has a large positioning angle to produce the tight calendering radius, the thrust entailed by an axial stress on the profile, and therefore its instability, are high and accordingly cannot be withstood by the profile, which yields below a certain radius.

It is also known to perform combined bending and calendering after other operations, particularly after filling with hygroscopic granules mixed with deformable granules of foamed polystyrene, which can be placed inside the profile.

This filling must of course be performed prior to the bending-calendering operations.

In addition to the above mentioned drawbacks, this solution also entails a considerable shortcoming, which consists in having, at the end of the process, a frame that is already finished since it contains the hygroscopic material in its hollow part.

Accordingly, there is the restriction of having to form the frame only a few minutes before its final utilization, that is to say, before hermetically closing on said frame two glass plates to form the insulating glazing unit.

In industrial practice, therefore, this solution is not feasible, in that it is not possible to manufacture spacer frames that are already filled with hygroscopic granules, since it would be necessary to provide a storage buffer prior to its application in the line for producing insulating glazing units and therefore the salts would absorb the surrounding moisture, losing their effectiveness once they are coupled to the glass plates.

There is also another problem, linked to the high cost of any machine having the above mentioned characteristics, since the section for automatically filling with the hygroscopic material can be compared with the bending-calendering section in terms of complexity.

SUMMARY OF THE INVENTION

A principal aim of the present invention is therefore to eliminate the described technical problems, eliminating the drawbacks of the mentioned known art and thus providing an automatic method and device which allow to give a curved shape to aluminum profiles for producing spacer frames for insulating glazing units, in which said shape can be given at the bending machine itself, without interrupting the production cycle to change or calibrate tools.

Within the scope of this aim, an important object is to provide a method and a device that allow to obtain curved shapes in which the curvature radiuses are minimal and even tend to zero.

Another important object is to provide a device comprising a very small number of components, having a low cost, and associable with a known bending machine.

Another object is to provide a device that is reliable and safe in use.

This aim, these objects, and others which will become apparent hereinafter are achieved by an automatic method for calendering aluminum profiles for producing spacer frames for insulating glazing units, said profiles having a surface on which minute holes are formed, characterized in that said calendering is achieved by deforming said surface beforehand so as to obtain an inside curve and a consecutive plurality of minute bends the pitch increment whereof tends to zero and the bending angle increment whereof tends to zero; and by an automatic device for calendering aluminum profiles for producing spacer frames for insulating glazing units, said profiles having a surface on which minute holes are formed, said device being associable with a bending machine and being characterized in that it comprises a means adapted to produce a preliminary deformation of said surface to obtain an inside curve at which said calendering is performed, means being provided for forming a number n of minute bends in which the increment in the bending angle $\alpha$ tends to zero and the increment in pitch p tends to zero.

BRIEF DESCRIPTION OF THE DRAWINGS

Further characteristics and advantages of the invention will become apparent from the following detailed description of a particular but not exclusive embodiment thereof, illustrated only by way of non-limitative example in the accompanying drawings, wherein.

DESCRIPTION OF THE PREFERRED EMBODIMENTS

Figure 1:
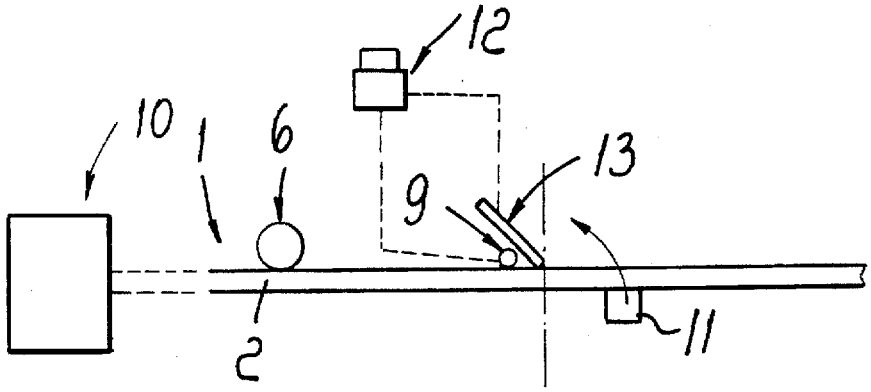
FIGS. 1 to 5 are schematic views of the various steps for achieving calendering.

With reference to the above figures, the reference numeral 1 designates a spacer frame for insulating glazing units constituted by a profile 2 having a surface 3 on which a plurality of minute holes 4 are formed.

Said surface 3 is connected to the inner space provided in the insulating glazing unit.

The profile 2 contains a cavity 5 that acts as a seat for hygroscopic material.

The method according to the present invention allows to give the profile 2 a curved shape; said profile is fed at an adapted and known bending machine, starting from a "magazine" at which the profiles, essentially arranged longitudinally, are coupled sequentially one with another.

For this purpose, the method entails producing a preliminary deformation at the surface 3 of the profile, for example by means of a wheel 6, producing an inside curve 7 proximate to the perimetric edges 8*a* and 8*b* of the surface 3.

In this manner, the profile 2 is radiused transversely.

Specifically, the wheel 6 is pressed against the surface 3 to produce the inside curve 7 upstream of the subsequent microbending station, schematically designated by the reference numeral 9.

After producing the inside curve 7, an adapted station 10 for conveying and feeding the profile 2, which is part of the bending machine, pushes said profile until the inside curve affects the microbending station 9.

The bending machine comprises a bending station 13 that can assume the desired shape, such as for example the one disclosed in Italian Patent application TV93A000084 filed on Sep. 14, 1993 and thus can use two punches, each punch interacting at one of the perimetric edges 8*a* and 8*b* of the profile 2 to prevent them from being undulated.

Figure 9:
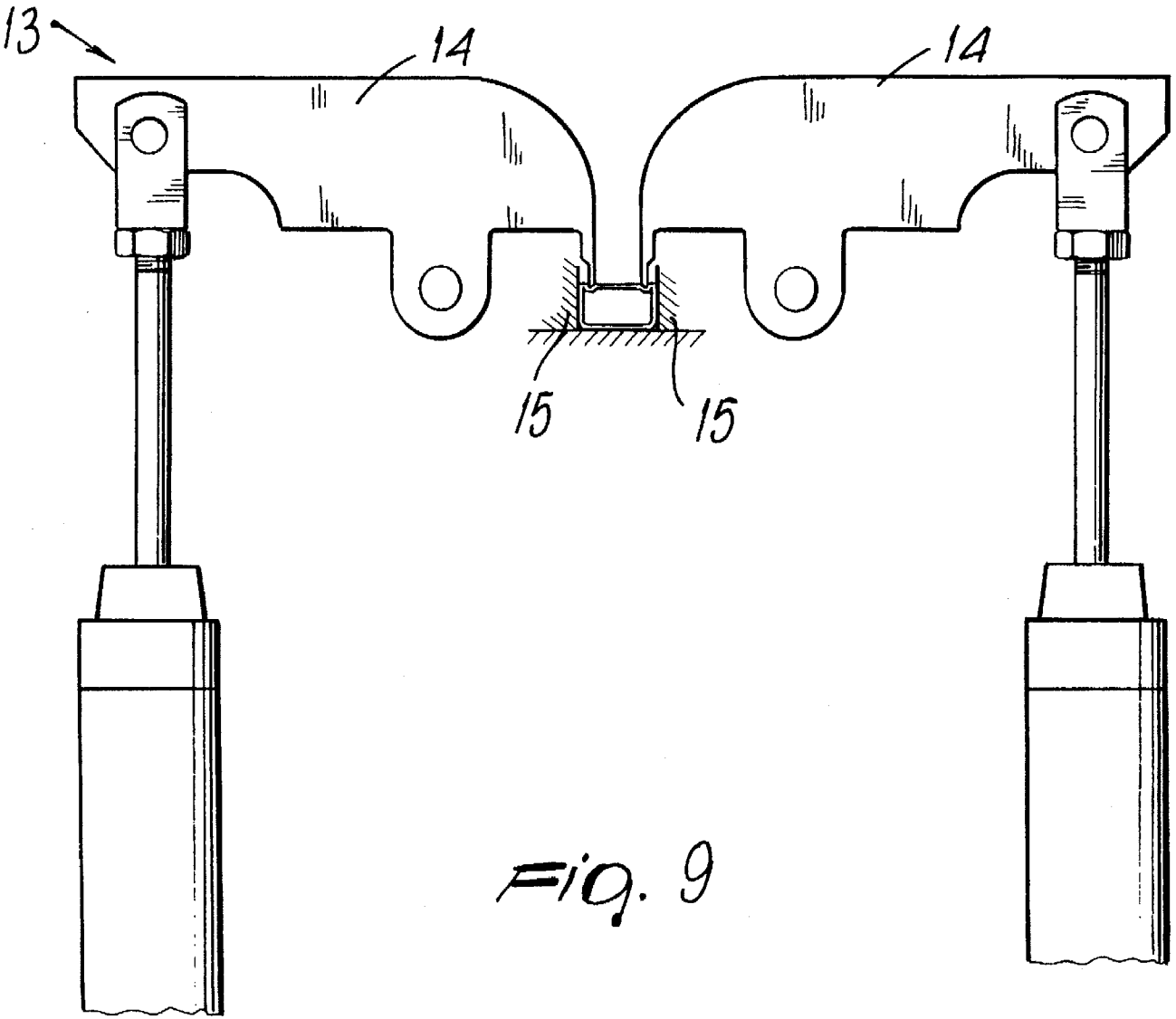
FIG. 9 is a cross-sectional view showing the bending fulcrum of the bending machine.

The punches or punching means may be of the type shown in FIG. 9 which are constituted by hooks 14 forming a fulcrum. The hooks 14 act on the inside surface of the profile 2 and force it to remain adherent to the lateral walls 15 of a vice 16 gripping the profile 2 for the microbending.

The device comprises automatically controlled microbending means adapted to produce a number n of minute bends, with a desired increment in pitch p that can be determined beforehand by the conveyance and feeding station 10, and forming a bending angle $\alpha$ that is achieved by means of an adapted rotation arm 11 associated with the bending machine.

Figure 2:
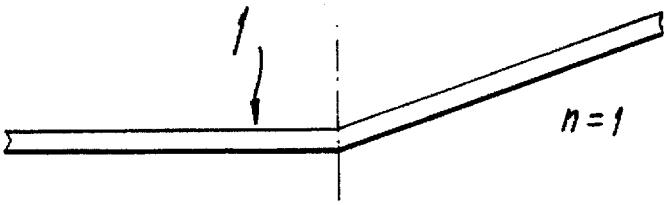
Figure 3:
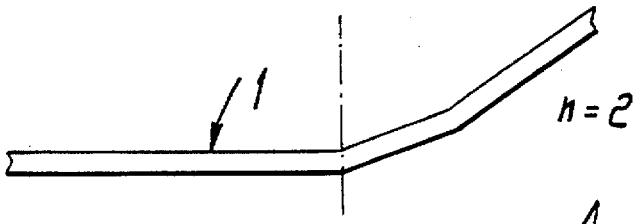
Figure 4:
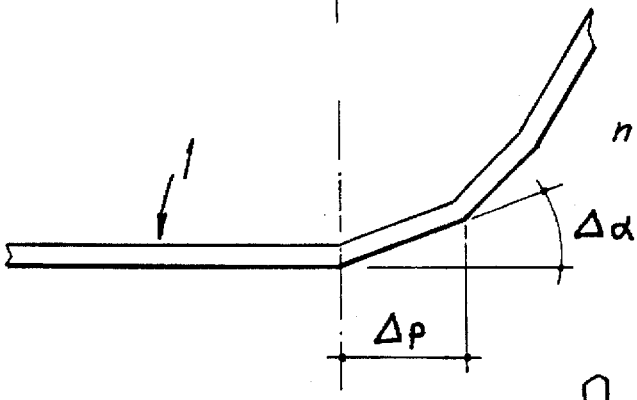

FIGS. 2, 3, and 4 are views of an embodiment, given by way of example only to show the characteristics involved in order to achieve the calendering of the profile 2 with the help of the bending machine: essentially, according to the method, a number n of minute bends that tends to infinity, with a bending angle increment $\Delta\alpha$ that tends to zero (see FIG. 5) and a pitch increment $\Delta p$ that tends to zero, are produced by virtue of microbending means of said microbending station controlled by and comprising an electronic computer 12.

Figure 10:
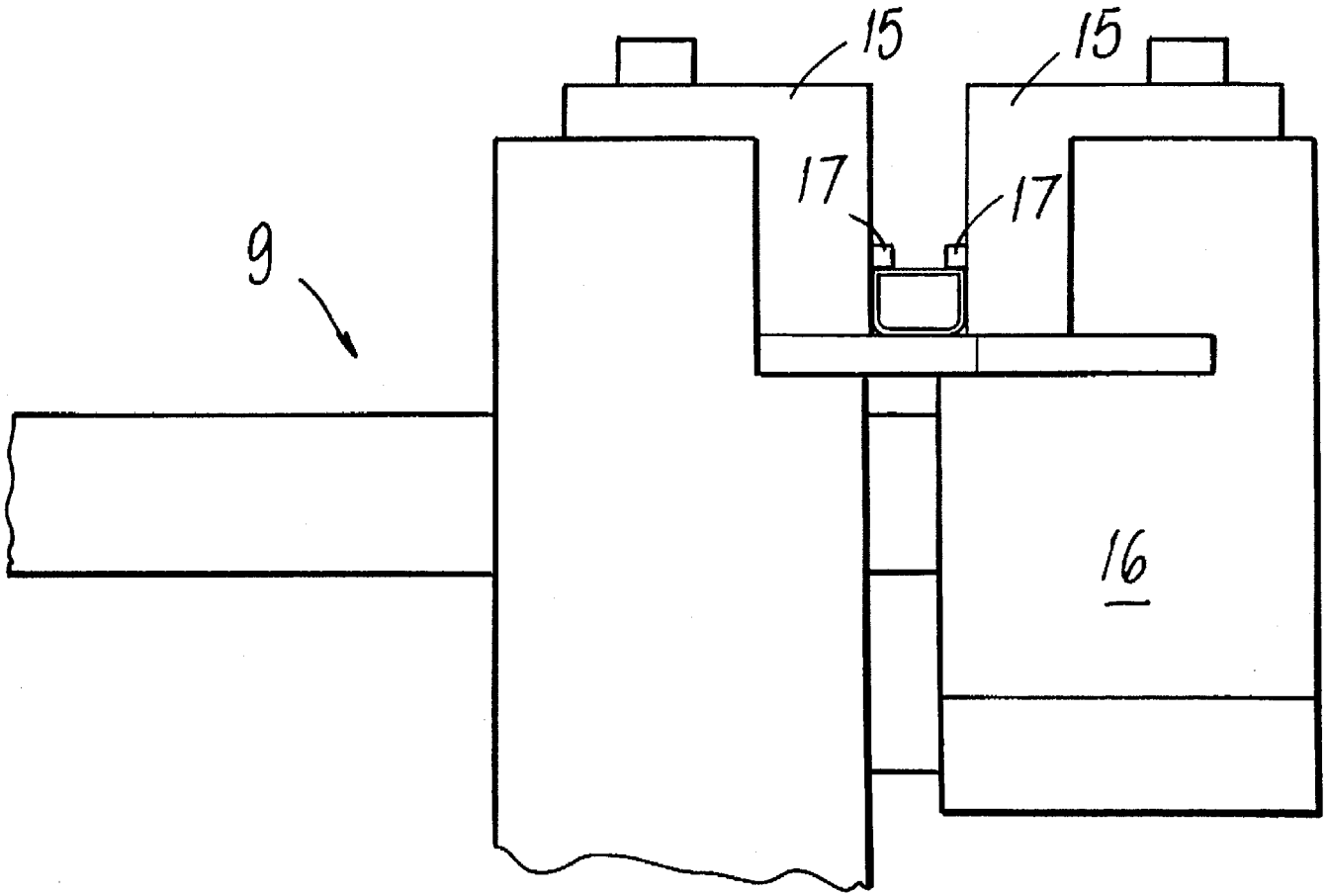
FIG. 10 is a lateral view of the microbending station.

The microbending means also comprise in a preferred embodiment two microbending protrusions 17, having a cylindrical shape and protruding from the lateral walls of the vice 16 above the profile which has to be calendered (see FIG. 10).

Figure 5:
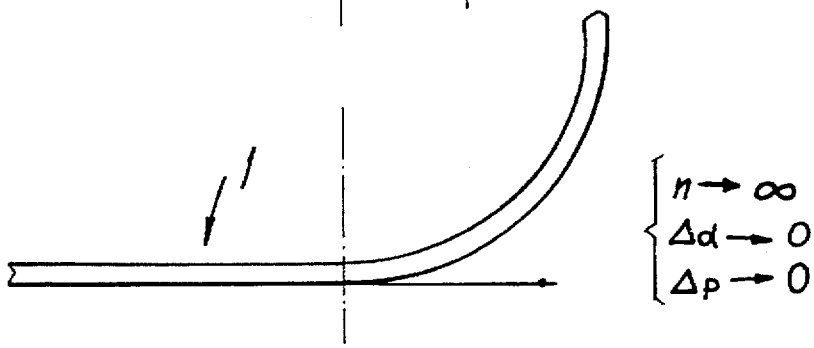
Figure 6:
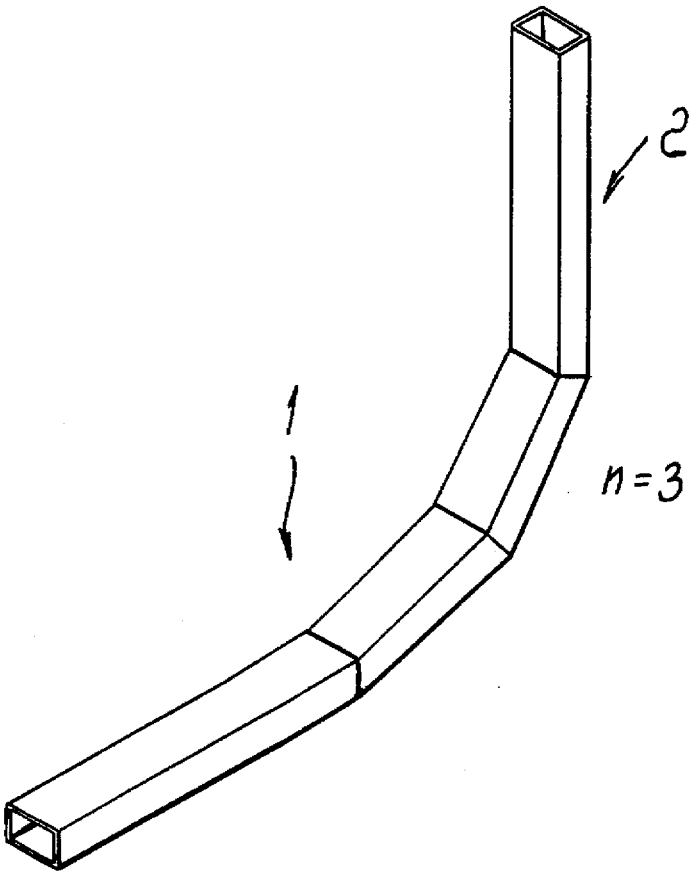
FIG. 6 is a lateral perspective view of the schematic diagram of FIG. 4.
Figure 7:
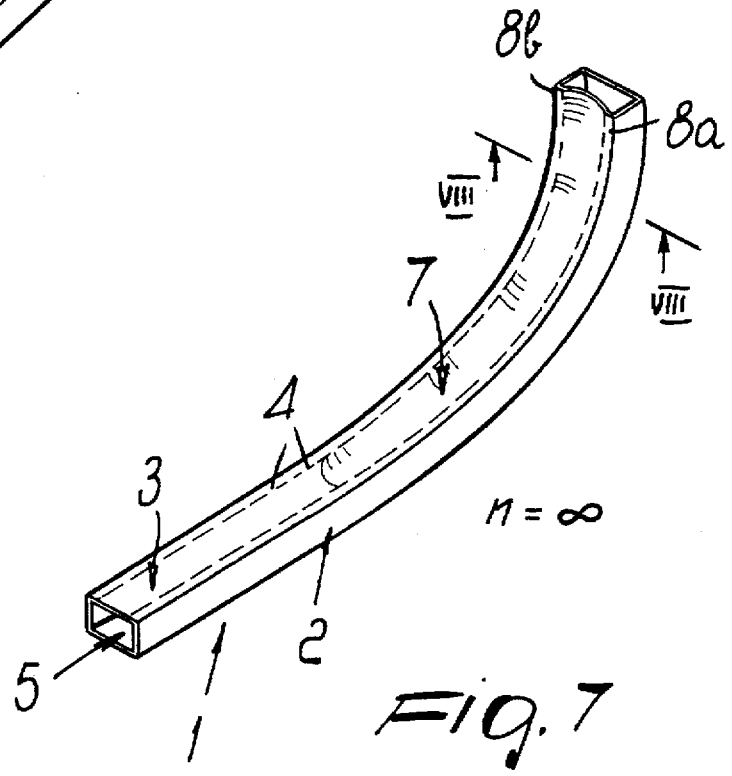
FIG. 7 is a view, similar to the preceding one, of the calendered profile condition shown in FIG. 5.

In this manner the configuration shown in FIGS. 5 and 7 is obtained.

Figure 8:
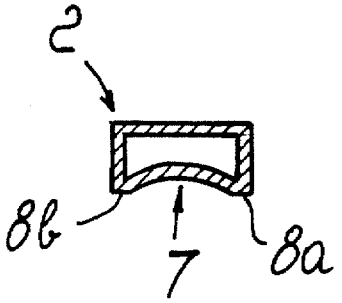
FIG. 8 is a sectional view, taken along the plane VIII—VIII of FIG. 7.

From the above description and the enclosed figures it will be clearly understood that the automatic calendering device, according to the invention, is included in the exemplary preferred embodiment, in a bending machine, eventually comprising in combination, in the working flow sequence: the feeding station 10, which feeds profiles at an automatically controllable pitch increment; the curving means, active only to create the cross deformation 7 of FIG. 8 and consisting in the wheel 6; the microbending station 9 consisting in microbending means, specifically the protrusions 16 extending from the walls 15 of the vice 16 for cooperating with the rotation arm 11, and adapted to impart to the profile 2 the desired bending angle by acting thereon after being advanced by the station 10 at small, automatically controlled pitch increments, in particular as shown in FIGS. 1–5, with for example the arm 11 pushing the profile up about the protrusions 17 by performing automatically controlled strokes; and the bending station 13, having the hooks 14 acting on the profile, immediately after the protrusions 17, to keep it in abutment against the walls 15 of the vice 16, the hooks 14 operating, conveniently along an inclined direction with respect to the advancement direction of the profile 2, as shown in FIG. 1, in cooperation with the same rotation arm 11 in cases when the profile has to be bent to form a corner angle (for example a 90° angle).

It has thus been observed that the invention has achieved the intended aim and objects, a device having been provided which, when associated at a known bending machine, allows to give a curved shape to aluminum profiles for producing spacer frames for insulating glazing units without interrupting the production cycle, since it is not necessary to perform any tool change or calibration.

This calendering, which therefore essentially consists of microbending with angles and pitch increments that tend to zero, allows to use known bending machines without lower limits to the value of the radius of curvature and allows to perform a machining of the spacer frame with very low production costs.

The invention is of course susceptible of numerous modifications and variations, all of which are within the scope of the same inventive concept.

For example, the method can be applied to profiles 2, on which cusp-folded shapes can be optionally inserted alternately by action, for example, of only the bending hooks 14 in cooperation with the rotation arm 11.

The components, as well as the materials that constitute the individual components of the device, may of course also be the most appropriate according to the specific requirements.

What is claimed is:

1. In combination a bending machine for bending profiles for insulating glazing unit spacer frames, the profiles having a perforated surface on which minute holes are formed and perimetric edges between which said perforated surface extends, the machine including:

feeding means for feeding a profile along a working flow path at an automatically controllable pitch increment;

a bending station;

a rotation arm;

and a calendering device, said rotation arm cooperating with said bending station and said calendering device for imparting to the profile a desired bending angle, and said calendering device comprising:

a curving means for producing a preliminary cross deformation of said perforated surface so as to obtain between said perimetric edges an inside curve; and an automatically controlled microbending station for forming on said profile, in cooperation with said rotation arm a number n of minute bends in which an increment of a bending angle $\alpha$ tends to zero and an increment in a bend pitch p tends to zero, said microbending station being located along said working flow path, downstream of said curving means, and immediately upstream of said bending station;

and wherein said bending station comprises punching means for acting on said profile, during operation of said microbending station, at said perimetral edges for preventing undulation thereof.

2. The combination of claim 1, wherein said curving means comprises a wheel which is pressed against said perforated surface to obtain said inside curve, said wheel having an axis that lies at right angles with respect to said working flow path.

3. The combination of claim 1, wherein said microbending station comprises an electronic computer for controlling operation of the bending machine according to a CAM (Computer Aided Manufacturing) process, said computer collecting, in an appropriate program, data such as the pitch increment, the bending angle increment, and the number of bends as a function of a radius of curvature and of a maximum value of the final curvature angle of said profile.

4. The combination of claim 1, wherein said microbending station comprises: a vice, said vice including lateral walls for gripping the profile to be calendered; and microbending means for forming in cooperation with said rotation arm a number n of minute bends in which an increment of a bending angle $\alpha$ tends to zero and an increment in a bend pitch p tends to zero, said microbending means being constituted by two microbending protrusions extending from said lateral walls of the vice in a position above said profile to be calendered.

5. The combination of claim 4, wherein said punching means comprises a pair of hooks forming a fulcrum, said hooks acting on said profile for forcing said perimetral edges thereof to remain adherent to the walls of said vice during operation of said microbending means.

6. The combination of claim 4, wherein said hooks are positioned immediately downstream of said microbending means for operating along an inclined direction with respect to the working flow path for feeding the profile, said hooks being actuatable in cooperation with said rotation arm for bending the profile at a corner angle.

7. In combination a bending machine for bending profiles for insulating glazing unit spacer frames, the profiles having a perforated surface on which minute holes are formed and perimetric edges between which said perforated surface extends, the machine including:

feeding means for feeding a profile along a working flow path at an automatically controllable pitch increment;

a bending station, said bending station comprising punching means for acting on said profile at said perimetral edges;

a rotation arm;

and a calendering device, said rotation arm cooperating with said bending station and said calendering device for imparting to the profile a desired bending angle, and said calendering device comprising:

a curving means for producing a preliminary cross deformation of said perforated surface so as to obtain between said perimetric edges an inside curve; and an automatically controlled microbending station for forming on said profile, in cooperation with said rotation arm a number n of minute bends in which an increment of a bending angle $\alpha$ tends to zero and an increment in a bend pitch p tends to zero, said microbending station comprising a vice which is located along said working flow path, downstream of said curving means, and immediately upstream of said bending station, said vice having lateral walls for gripping therebetween the profile, said punching means acting on said profile for achieving calendering thereof by forcing said perimetral edges to remain adherent to said lateral walls of said vice during operation of said microbending means.

8. An automatic method for calendering aluminum profiles for insulating glazing unit spacer frames with the bending machine of claim 7, the profiles having a perforated surface on which minute holes are formed and perimetric edges between which said perforated surface extends, the method comprising:

a first step of feeding a profile along a working flow path at an automatically controllable pitch increment;

a second step of preliminary curving the profile fed along said path for producing a preliminary cross deformation of said perforated surface so as to obtain between said perimetric edges an inside curve;

a number of consecutive automatically controlled calendering steps, said calendering steps including in combination microbending said profile for forming a number n of minute bends in which an increment of a bending angle $\alpha$ tends to zero and an increment in a bend pitch p tends to zero, and acting at the same time on said profile by forcing said perimetral edges thereof to remain adherent to said lateral walls of said vice during the microbending.

9. The method of claim 8, wherein the preliminary cross deformation is formed at the perforated surface of said profile through at least one wheel forming said inside curve proximate to the perimetric edges of said perforated surface.

10. The method of claim 9, wherein said profile is radiused transversely as a consequence of said preliminary cross deformation.

11. The method of claim 10, wherein after forming said inside curve, said profile is pushed along said flow path until the profile reaches with said inside curve thereof the microbending station.

12. The method of claim 8, wherein said consecutive steps for forming minute bends are automatically controlled by an electronic computer, so as to obtain a number n of minute bends that tends to infinity, with an increment in the bending angle $\alpha$ that tends to zero and a pitch increment p that tends to zero.

13. The method according to claim 8, wherein said calendering is achieved by using the microbending means provided at the microbending station without any tool change or calibration being necessary.

14. The method according to claim 8, wherein profiles are bent on which cusp-bent shapes are optionally included alternately by action of only bending hooks in cooperation with the rotation arm.

* * * * *